US006251148B1

(12) United States Patent
Redepenning et al.

(10) Patent No.: US 6,251,148 B1
(45) Date of Patent: Jun. 26, 2001

(54) PROCESS FOR PRODUCING SYNTHETIC GASSES

(75) Inventors: Karl-Heinz Redepenning, Raesfeld; Peter M. Wenning, Train, both of (DE)

(73) Assignees: John Brown Deutsche Entineering GmbH; Veba Oil Technologie, both of (DE)

( * ) Notice: Subject to any disclaimer, the term of this patent is extended or adjusted under 35 U.S.C. 154(b) by 0 days.

(21) Appl. No.: 08/616,060

(22) Filed: Mar. 14, 1996

Related U.S. Application Data

(63) Continuation-in-part of application No. 08/182,051, filed on May 29, 1994, now abandoned.

(51) Int. Cl.[7] ..... C01J 3/72

(52) U.S. Cl. ..... 48/197 R; 48/203; 48/204; 585/240; 585/241

(58) Field of Search ..... 48/197 R, 203, 48/209; 585/240, 241

(56) References Cited

U.S. PATENT DOCUMENTS

| | | | |
|---|---|---|---|
| 4,298,355 | 11/1981 | Staudinger | 48/206 |
| 4,300,915 | 11/1981 | Schmidt et al. | 48/197 |
| 4,302,353 | 11/1981 | Escher et al. | 252/373 |
| 4,385,905 | 5/1983 | Tucker | 48/62 |
| 4,497,637 | 2/1985 | Purdy et al. | 48/111 |
| 4,557,204 | 12/1985 | Faehnule | 110/346 |
| 4,891,459 | 1/1990 | Knight et al. | 585/240 |
| 4,941,890 | 7/1990 | Freimann et al. | 48/197 |
| 4,977,840 | 12/1990 | Summers | 110/346 |
| 5,290,327 | 3/1994 | Rossle | 48/111 |
| 5,364,996 | 11/1994 | Castagnoli et al. | 585/241 |

FOREIGN PATENT DOCUMENTS

| | | |
|---|---|---|
| 2721047 | 11/1978 | (DE) . |
| 2920922 | 6/1980 | (DE) . |
| 3048215 | 7/1982 | (DE) . |
| 4139512 | 6/1993 | (DE) . |
| 0011151 | 5/1980 | (EP) . |
| 055840 | 7/1982 | (EP) . |
| 0120397 | 3/1984 | (EP) . |
| 0143106 | 5/1985 | (EP) . |
| 0194252 | 9/1986 | (EP) . |
| 545241 | 6/1992 | (EP) . |
| 2109400 | 6/1983 | (GB) . |
| 8100112 | 1/1981 | (WO) . |
| 9002162 | 3/1990 | (WO) . |

*Primary Examiner*—Timothy McMahon
(74) *Attorney, Agent, or Firm*—Vickers, Daniels & Young

(57) ABSTRACT

A process for producing a synthetic and/or fuel gas from an organic containing material by utilizing a thermal pretreatment operation and a gasification reactor. The organic containing material is passed through a thermal pre-treatment operation to produce a gas fraction and a solid fraction. The solid fraction is processed in gasification reactor whereby product gas is produced, and contaminated products are processed for safe disposal. The thermal pre-treatment of the organic containing material produces a solid fraction which can be directly supplied to the gasification reactor without a need to supply a high quality coke to the gasification reactor thereby simplifying the process. The gas fraction and product gas produced from the thermal pre-treatment operation and/or gasification reaction, respectively, can be recycled so as to supply energy and/or processing gas for the various other processes.

24 Claims, 1 Drawing Sheet

PROCESS FOR PRODUCING SYNTHETIC GASSES

This patent application is a Continuation-In-Part application of my U.S. patent application Ser. No. 08/182,051 filed May 26, 1994, now abandoned, which is a 371 of PCT/EP92/01607 filed Jul. 15, 1992.

The present invention relates to a process for producing synthesis and/or combustion gases from organic components, and more particularly, the producing of production gas from solid or soft (paste-like) residue and/or waste substances that contain organic constituents, and/or process by-product substances.

INCORPORATION BY REFERENCE

U.S. Letters Pat. No. 4,298,355 illustrates a shaft-type gasification reactor which may be used and such patent is incorporated herein by reference.

BACKGROUND OF THE INVENTION

Presently, it is no longer acceptable to dump solid or soft paste-like residual and waste substances into waste sites due to existing environmental laws and regulations. As a result, the disposal of these materials has become vitally important to industries, government and consumers. Materials such as light shredded material from motor vehicles, plastics, lacquer and sludges such as solvent sludges and partially dewatered sewage sludge and the like are increasingly difficult and/or costly to dispose and pose a potential environmental problem.

Presently, low quality fuels, such as wet soft or brown coals having a high tar content, old tires, and the like can be gasified and disposed of without producing excessive levels of undesirable emissions in product gas and free or very nearly free of impurities which can reduce the heating value of the product gas, restrict the use of the gas in other processes, and pose significant hazards to the environment. One method of processing these materials is by using a shaft-type gasification reactor. Such reactors include a two or three layer charge bed in the primary gas chamber. The first layer of the charge bed consists of a relatively high-quality coke. The second layer of the charge bed includes a relatively thin layer of low quality fuel that lies on the first layer of the charge bed. The exposed surface of the second layer is arranged to face the primary gas chamber. The primary gas chamber is heated by fuel, oxygen, heated water, and/or steam. The primary gas chamber is heated to cause an endothermic gasification reaction. Materials such as waste oil and/or a paste-like residue from paper plant can be used as fuel for the primary gas burner. The heated gas that results from combustion of the waste oil and/or residue reaches a temperature of about 1500 to 1800° C. The heated gas is directed to contact first layer of high quality coke and then the second layer of low quality fuel such as shredded tires. The endothermic reaction of the low quality fuel and heat gas forms a crude gas. The crude gas, which is formed, reaches a temperature of about 1864° C. The crude gas exiting the gasification reaction is a gas having low levels of impurities. If a third layer is used in the gasification reactor, the third layer is a high quality coke that is similar to the first layer. Depending on the thickness of the low quality fuel second layer and on the adjustment of the primary gasification, the third layer, if used, will be gasified as the second layer and/or act as a filter for impurities for the crude gas passing through the third layer. The adjustment of the primary gasification is effected by regulating the ratio of oxygen to carbon carriers in the burner; by regulating the total quantity of primary gasification substances and/or in the event that pure oxygen is introduced through the burner in place of air, by way of the ratio of oxygen to steam. Such a gasifier is disclosed in EP 0 011 151 B1.

Tests conducted with the shaft-type gasifier disclosed in EP 0 011 151 B1 have shown that considerable problems arise during the high temperature gasification of a number of substances such as, for example, the light shredder fraction from a motor vehicle. In many cases, it is difficult to introduce this charge into the gasification zone, i.e., especially into the primary gas chamber, evenly enough that the product gas is of a sufficiently uniform quality. In the past, this problem was attempted to be solved by forming the charge into briquettes in order that it can be uniformally introduced into the shaft type gasifier. However, the process for producing the briquettes is extremely costly and there are many problems associated with the formation of the briquettes.

Another attempted solution, which has had little, if any success, relates to the grinding up the low quality fuel into relatively small particles and processing such fuel in a fly flow gasification reactor. This grinding procedure is problematic in that substances such as glass, stone, iron and others, which periodically damage the grinder, and fly flow gasification reactor are commonly present in the low quality fuel. Furthermore, these non-organic products impair the operation of a fly flow gasification reactor. In addition, the grinding process and use of a fly flow gasification reactor are extremely cost-intensive.

The disposal of waste materials of varying compositions that contain carbon, such as household garbage and industrial waste for producing a fuel gas is known from EP 0 120 397 A3. In this process, the carbon-containing waste is smoldered in a rotary tube reactor at more than 200° C. to obtain a low temperature carbonized gas and pyrolysis coke. The pyrolysis coke is subsequently gasified in a fluid bed gasifier. The gasification products leave the gasifier at relatively low temperature typically between 400° C. and 1000° C. The liquid and the gaseous constituents released during the low temperature carbonization step and the gasification step are subsequently burned resulting in a substantial amount of ash which must be disposed of. This process results in a problem of environmentally disposing the ash. Furthermore, the process does not operate when processing materials such as a light shredder fraction from motor vehicles since such material include non-organic materials such as glass, metals, etc. A similar process as described in the EP 0 120 397 A3 is moreover known from the WO 90/02162 and has the same problems associated with the process of EP 0 120 397 A3.

In another waste disposal process which is described in the U.S. Pat. No. 4,497,637, the processing of various types of heterogenic substances is not suitable for processing and/or cannot be disposed of in an environment friendly manner. In this process, a synthetic gas is produced from a bio-mass such as wood chips. The bio-mass is formed by mechanical and thermic (drying) pre-treatment prior to the disposal of the materials. The pre-treatment is followed by a combined process of fly flow pyrolysis and fly flow gasification, both being performed in the so-called downflow, whereby the fly flow pyrolysis takes place in an outer zone and the gasification takes place in an inner zone of a mutual concentrically constructed fly flow reactor. The pyrolysis is effected at a temperature of up to 870° C. Thus, the temperature of the pyrolysis step is extremely high. Moreover, the hot carrier gas from the pyrolysis step contains nitrogen, water steam and CO2. The reaction pressure in the fly flow pyrolysis chamber ranges between 1 and 5 atmospheres under which a gasification of the mechanically and thermically pre-treated bio-mass begins. This waste disposal process includes a complicated pre-treatment step and complicated and costly pretreatment of the bio-mass prior to processing.

A similar process is disclosed in GB 2,109,400 A. The production of a synthetic gas results from a fibrous bio-mass, such as wood chips. After a pyrolytic pre-treatment of the bio-mass, a slurry gasification is carried out. This gasification requires a relatively high liquid carrier portion of approximately 40%. The gasification is effected at relatively low process temperatures, i.e. temperature below the softening point of the ashes. This process cannot process a wide variety of products.

Another process for disposing feed products containing carbon is disclosed in WO 81/00112. In this process of bituminous hard coal, brown coal, wood, straw are treated in a rotary tube pyrolysis. The process materials are then processed in a coupled crack and shaft gasification process by partially burning the low-temperature coke. Difficult process substances cannot be treated in this process.

In view of the deficiencies in the prior art to process waste components, there has developed a need to economically and environmentally dispose a wide variety of waste materials and to produce a process gas from organic materials which contains low levels of contaminants so that the product gas can be used safely as fuel in a wide variety of processes.

SUMMARY OF THE INVENTION

The present invention relates to a process for processing a wide variety of organic containing materials and to dispose of such materials in an environmentally friendly manner. Such organic material includes light shredder fraction that is obtained from motor vehicles, plastics and process substances that are similarly difficult to handle and/or residual and waste materials containing organic constituents.

In accordance with the present invention, there is provided a process for producing a synthetic or product gas from light shredder fraction from motor vehicles, solid or pasty residues or waste materials containing organic constituents, and/or process by-products by treating such products in a gasification reactor at temperatures of about 800° C. to about 1700° C. and higher. The process includes the separation of feed products into a gaseous and a solid fraction by heating the feed products in a thermal pretreatment process whereby heat is added to the feed products to substantially prevent the combustion of the feed products. This is the pyrolysis treatment of the feed products. The solid fraction is subsequently gasified in a gasification reactor. Prior to gasifying the solid charge, useful materials, such a metal may be separated out of the solid fraction. In the gasification reactor, the solid fraction is converted into the synthetic or product gas and a disposable product that is safe to be environmentally disposed of. The gaseous fraction can be used in various process steps of the present invention such as supplying heat to the endothermic reaction in the gasification reactor. Preferably, the gas fraction is 1) supplied to the gasification reactor as a heat source and/or a feed material, 2) processed in a condensation stage to be split into a liquid product and a gas product, 3) combined with the product gas produced from the gasification reactor and/or 4) supplied to the pyrolysis treatment stage as a heat source. If the gas fraction is treated in a condensation stage, the liquid fraction that is formed is preferably 1) used as a heat source for various stages in the process of the present invention process, 2) fed directly into the gasification reactor and/or 3) combined with the solid fraction and/or other heterogeneous material prior to being fed into the gasification reactor. After the initial separation of the gas fraction from the solid fraction of the feed product, the grain bandwidth (particle size distribution) of the solid fraction that results after the pyrolysis treatment stage preferably is reduced by grinding, sieving and/or screening prior to feeding the solid fraction to the gasification reactor. If the gas fraction is passed through a condensation stage, the solid fraction that results after the pyrolysis treatment stage and the liquid fraction that results after the condensation stage can be mixed and passed to the gasification reactor together, preferably by means of a pump or worm conveyor. The product gas that results after the gasification reaction, and optionally the gas that results from the condensation stage, can be used, if necessary, after the removal of undesirable products as gaseous fuel, for operating a power station such as a block heating power station.

A number of the significant advantages are achieved by using the present invention. During the thermal pretreatment stage (the pyrolysis treatment stage) of the feed product, particularly when the substance is a light shredder fraction, the gas fraction and the solid fraction occur in a quantitative ratio of combustible or gasifiable material such as is required to operate a gasification reactor (approximately 60% gas fraction and approximately 40% solids fraction ); thus, for all practical purposes, there will be no requirement to burn other fuels to heat the gasification reactor.

The gas and/or liquid fraction from the thermal pretreatment of the process substance that is to be supplied to the gasification reactor may contain solid constituents in the form of fine-grained material, in particular in the form of dust, without impairing the various process steps.

In addition, the solid fraction formed from the thermal pre-treatment stage has similar properties as metallurgical coke; thus, for this reason, it is possible to dispense entirely with the use of metallurgical coke, for example, during the gasification process, so that the solid feed in the gasification reactor consists only of the solid fraction resulting from the thermally treated feed products. Therefore, if a shaft-type gasification reactor is used, the gasification reactor no longer requires two different charges, thus simplifying the processing of the feed products.

Furthermore, during the gasification of the feed product, no environmental toxins such as dioxins and oxides of nitrogen are formed, since the dioxins cannot exist during the gasification that is carried out under substoichiometric conditions. In the event that dioxins and oxides of nitrogen are present in the fuel of the primary gas burner, such compound is destroyed at the relatively high combustion temperatures that are used. Oxides of nitrogen from the primary gas combustion are also reduced under gasification conditions. Any metal oxides that may be produced during the processing of the feed products have a lower degree of oxidation, thus less toxic. Ballast materials, e.g., metals, that are in the feed products can be separated off from the solid fraction after the thermal pre-treatment stage by using a conventional separation stage before the solid fraction is passed to the gasification reactor. Therefore, the introduction of the solid fraction into the gasification reactor is thus made much simpler and more uniform.

The special combination of thermal pre-treatment and the subsequent gasification of the solid fraction in the gasification reactor has the advantage processing a broad range of the feed products to be disposed of by a simple process that forms a synthetic gas of uniform product quality and a substantially safer slag material.

Surprisingly it has been found that the above mentioned advantages are not obtained with the present disposal processes wherein the gasification is carried out in a fluid bed, i.e. a defined stationary or circulating fluid bed. In such disposal processes, a solid residue is formed, such as cyclone ash which contains a high amount of non-reacting carbon (e.g. 5%) which substance can no longer be disposed of due to present environment rules and regulations.

In accordance with another aspect of the present invention, the gasification reactor is a fly flow gasification reactor. Gasification reactors that operate according to the fly flow principle are known in the art, thus will not be described in detail. Fly flow gasifyers which can be used in the present invention are disclosed in DE 2,721,047 C2 and EP 0 001 151 B1. Grain bandwidths of about 0.001 mm to about 5 mm are preferably used in the fly flow gasifiers. Therefore, after the pyrolysis treatment and prior to fly flow gasification, the solid fraction that results after the pyrolysis treatment stage is preferably adjusted with respect to its grain bandwidth by grinding, screening, and/or separation (i.e. Class 2).

In accordance with another aspect of the present invention, a shaft type gasifier is used. Preferably, the solid fraction formed from the pyrolysis treatment stage is directly fed into the shaft type gasification reactor. Special adjustment of the grain bandwidth and special handling requirements are not required. The shaft type gasification reactor preferably has a shaft like container for accommodating the solid fraction. The solid fraction is moved into a passageway that is located at the lower end of the shaft-like container. A primary gas chamber that is fired by a primary gas burner and which is arranged beneath the shaft-like container is connected to the passageway of the shaft-like container. Within the primary gas chamber, a charge surface that faces the primary gas burner of a charge bed and is formed by a coke layer beneath the passageway forms a supporting surface for the solid fraction that moved into the passageway. The product gas and reacted solid fraction are drawn off from the gasification process in a suitable manner after being processed. Preferably, a substantial amount of the gas fraction that is formed in the pyrolysis treatment stage is feed to the primary gas burner to supply heat to the gasification reactor during the endothermic gasification process. The gas fraction and, if necessary, additional fuels, can be supplied to the primary gas chamber. The shaft type gasification reactors are well known in the art, thus further details need not be described. A shaft type gasification reactors which can be used in the present invention is disclosed in EP 0 194 252 B1 and U.S. Pat. No. 4,298,355.

In accordance with another aspect of the present invention, the gas fraction that is formed following the pyrolysis treatment stage is first passed through a condensation stage. The gas fraction that is formed after the condensation stage is preferably re-utilized in the production process. To this end, this gas fraction is fed to the gasification reactor and/or fed to the pyrolysis treatment stage as a source of heat and/or combined with the product gas that is formed in the gasification reactor for a source of fuel and/or heat.

In accordance with yet another aspect of the present invention, the liquid fraction that occurs after the condensation stage is preferably used as a source of heat in other process stages and/or fed into the gasification reactor. If the liquid fraction is fed to the gasification reactor, the liquid fraction is preferably combined with the solid fraction that is formed after the pyrolysis treatment. A pump or a worm conveyor is preferably used to feed the mixture to the gasification reactor. Such pumps or worm conveyors are known in the art and are disclosed in DE 2,721,047 C2 and EP 0 011 151 B1.

In accordance with still yet another aspect of the present invention, the product gas and/or the gas fraction from the condensation stage are used as fuel for operating a power station or an already existing power station such as a block heating power station. Prior to using the product gas as a gaseous fuel, the product gas may be scrubbed to remove any toxic or harmful substances.

In accordance with another aspect of the present invention, the inorganic residual or other waste substances are processed to remove contaminating substances by processing such materials in the pyrolysis treatment stage and/or in the gasification reactor. If such materials are processed in the gasification reactor, such materials are preferably added to the solid fraction.

In accordance with still another aspect of the present invention, the gasification in the gasification reactor is carried out under a pressure of preferably about 10 bar to about 100 bar. Higher gasification pressures can be used. Alternatively, the gasification can be carried out at atmospheric pressure or in a slight vacuum. If gasification is carried out in a vacuum, a suction-draft blower is preferably used.

In accordance with another aspect of the present invention, the feed products to be processed are preferably solids, paste-like substances, solid-liquid mixtures, thickened liquids (i.e. residual or waste materials) which contain organic constituents. These feed products can be directly processed or mixed with other feed materials prior to processing. The liquid materials can be directly converted to form product gases in other processes.

In accordance with yet another aspect of the present invention, the gasification reactor may include a fly flow gasifier, a shaft-type gasifier, or a fluid bed gasifier.

In summary, there is a process for production of synthesis and/or combustion gases (product gas) from solid or soft (paste-like) residual and waste substances that contain organic constituents feed products. These materials are generally difficult to handle, such as shredder light fraction from motor vehicles. The process includes initially separating the feed products into a fraction that is gaseous under operating conditions, and in particular in the form of vapor, and a solid fraction, by thermal pre-treatment. During this step, heat is added in controlled amounts so as to essentially avoid combustion of the feed products and formed fractions (pyrolysis treatment). Thermal pre-treatment during the introduction of heat and essentially while avoiding combustion of the feed products and fractions can be effected in a variety of ways. So-called pyrolysis or pre-treatment systems are generally known for this purpose, thus will not be further explained here. Pyrolysis systems may include fluid bed reactors or heated rotary cylinder reactors. Once the solid fraction and gas fraction have been formed, one or more of the fractions are gasified in the gasification reactor to produce product gas. The gas may be used, at least in part, in the production process so as to introduce process heat and/or to produce additional quantities of product gas. The solid fraction is preferably fed into the gasification reactor or after separation of the useful substances. Preferably, the gasification reactor is an entrained bed gasification reactor. The gas fraction may be 1) fed to the gasification reactor, 2) fed to condensation stage to form gas product and a liquid product and/or 3) used to supply heat to the gasification reactor and/or to the pyrolysis treatment. The liquid product that results from the condensation stage is used as a liquid in other process, fed directly into the gasification reactor, mixed with the solid fraction and/or heterogeneous materials prior to being fed into the gasification reactor and/or used to introduce heat for various process stages. The organic residue and/or waste substances can be mixed with the feed products prior to the pyrolysis treatment and/or mixed to the gas liquid and/or solid fraction prior being fed into in the gasification reactor.

Heterogeneous materials such as shredder fluff or household waste can be added to the solid fraction prior to being fed into the gasification reactor without use of special pre-treatment stages. Only size reduction by a coarse shredder to a particle size of about 100 mm (depending on the configuration of the charging process) is preferable. Preferably, the grain bandwidth (particle size distribution) is reduced by grinding, sifting, sieving and/or screening. Preliminary drying is not required. Heterogeneous materials include different plastics and metals, as well as glass. The special combination of the thermal pre-treatment and subsequent gasification of the solid fraction in an entrained bed has the significant advantage that, despite the heterogeneity of the charge and despite the simple feed process for the charge, as well as the generally low-cost operation of the process, the creation of a synthesis gas of surprisingly uniform product quality is achieved. The solid fraction removed from the entrained bed gasification reactor is in the form of a slag. This slag prevents undesirable materials such as heavy metals and other material not processed or broken down in the reactor from leaching out, thus allowing the slag to be disposed without any environmental concerns. The solid fraction that results after the pyrolysis treatment stage and the liquid fraction that results after the condensation stage are preferably mixed and passed to the gasification reactor together, preferably by means of a pump, screw machine or worm conveyor. The product gas that results after the gasification reaction, and optionally the gas that results after the condensation stage, are preferably used, if necessary after removal of existing harmful substances (harmful gas constituents) as gaseous fuel for heating the gasification reactor and/or as fuel for operating a power station and/or an already existing power station such as a block heating power station.

The components or process steps of the present invention are not subject to any exceptional conditions with respect to size, configuration, selection of material, technical concept or operating conditions.

The primary object of the present invention is to provide a process for disposing waste products, by-products and the like, which contain a carbon material.

Another object of the present invention is to process materials in a pyrolysis treatment to separate the treated materials into at least a solid fraction and a liquid fraction substantially without causing the combustion of one or more of the produced fractions.

Yet another object of the present invention is the provision of providing a gasification reactor to process a solid fraction and/or liquid fraction to produce a product gas which can be used to provide energy for other processing steps and/or to a power station.

Still yet another object of the present invention is to process various types of difficult to handle materials such as solid or pasty residues and wastes containing organic and/or inorganic materials and to easily and cost effectively dispose of such materials.

Another object of the present invention is to provide a process for disposing materials in an environmentally friendly manner.

These and other objects and advantages will become apparent to those skilled in the art upon reading the following description taken together with the accompanying drawings.

BRIEF DESCRIPTION OF THE DRAWINGS

Reference may now be made to the drawing, which illustrates various embodiments that the invention may take in physical form and in certain parts and arrangements of parts wherein.

DETAILED DESCRIPTION OF PREFERRED EMBODIMENT

Figure 1:
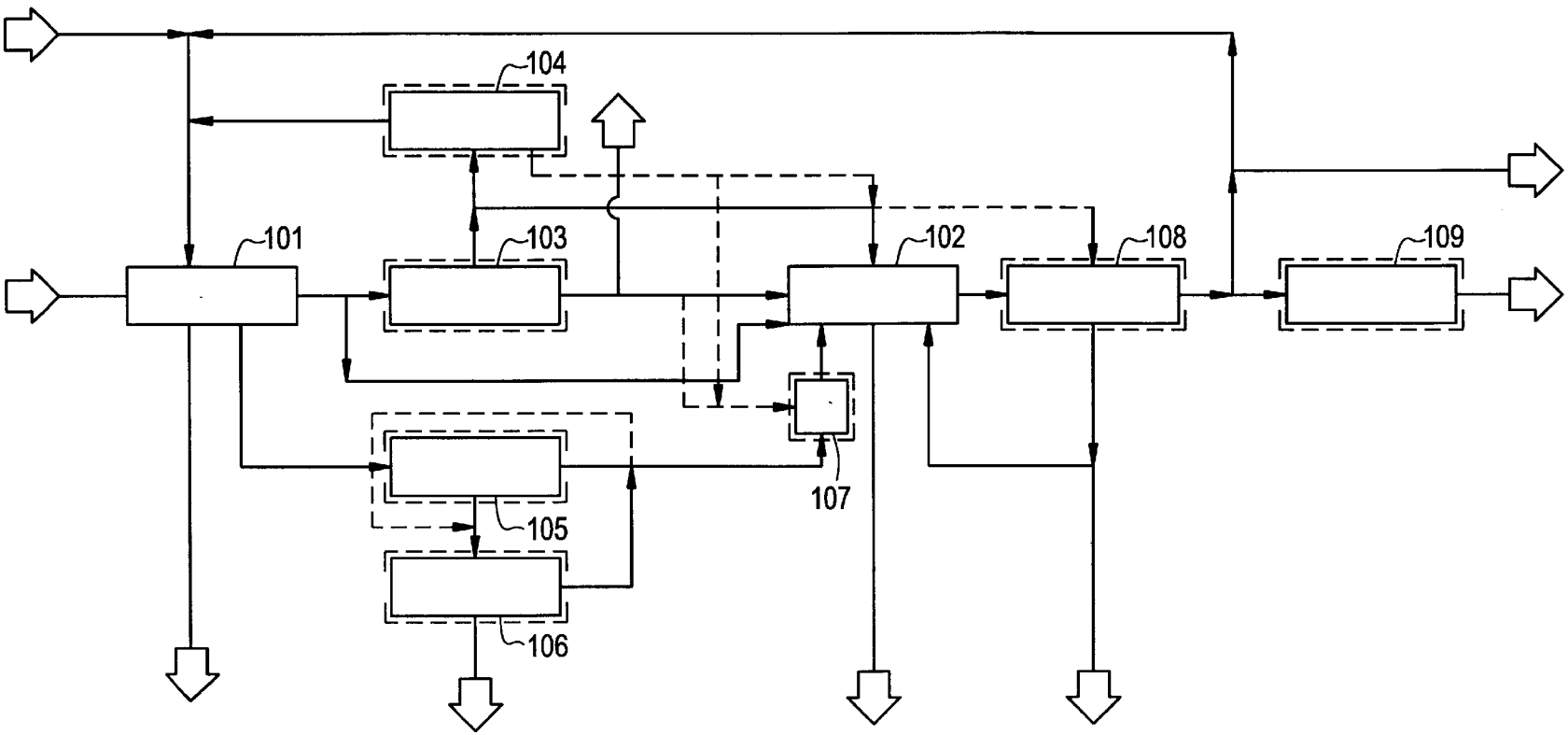
FIG. 1 is a block schematic diagram of the process of the present invention.

Referring now to the drawing, wherein the showings are for the purpose of illustrating the preferred embodiments of the invention only and not for the purposes of limiting the same, FIG. 1 illustrates a block schematic diagram of the processing of materials. Alternative process paths are indicated with dashed lines. Stages of the process that are used only as a matter of preference are bordered by an additional dashed line.

As illustrated in FIG. 1, a residual and/or waste substance subsequently referred to as the process substance or feed material, which contains organic constituents, is subjected to a pyrolysis treatment stage 101. The process material can be any type of solid, paste-like, liquid or vapor material which contains organic materials. The process material can range from easy-to-handle to difficult-to-handle materials. Difficult-to-handle materials include shredder light material such as from motor vehicles; plastics; oils; paints; solvents; solvent sludges; sludges; shredder fluff; household waste; and heterogeneous materials such as small appliances, toys, televisions and the like.

The pyrolysis treatment stage is preferably carried out in an indirectly heated rotary cylinder, not shown. The cylinder wall is heated to a temperature up to about 900° C. In the pyrolysis treatment stage, the process substance is preprocessed thermally, largely with no oxygen, while heat is supplied to heat the cylinder walls to temperatures between approximately about 300 and about 650° C. and having a de-gasing pressure of about $0.9\times10^5$ to about $1.2\times10^5$ pascal. The amount of heat and oxygen are controlled so as to substantially avoid combustion of the process substance during the pyrolysis treatment. Foreign gas and/or product gas that results after the gasification reactor 102, product gas from gasification reactor 102 which is scrubbed in gas scrubber stage 108, pyrolysis gas that results after a condensation stage 103 and/or a gas product that results after condensation stage 103 and cleaned in cleaning stage 104 can be used to introduce the heat to pyrolysis treatment stage 101.

The fraction that is formed in the pyrolysis treatment stage 101 from the process substance is drawn off separately as vapor (gas fraction) and coke (solid fraction). It is understood that any liquid fraction that results can be a constituent of the "solid fraction" and/or the "gas fraction." Preferably, the grain bandwidth (particle size distribution) of the solid fraction is adjusted in a grinding, sieving, sifting, air separator and/or screening stage 105 to the size that is appropriate for the particular type of gasification reactor 102. The solid fraction is fed to the gasification reactor 102 by pneumatic means, pump, screw drive, worm drive, etc. 107. Solid substances in the solid fraction that are of value, such as metals, can be removed in a separation stage 106, e.g., a sieve apparatus, air separator or the like, before the solid fraction is fed to the gasification reactor 102.

The gas fraction that is formed after the pyrolysis treatment stage 101 is supplied as vapor either to the gasification reactor 102 for gasification; used to introduce reaction heat to pyrolysis treatment stage 101 and/or gasification reactor 102; and/or is passed through a condensation stage 103. If the gas fraction is fed to a condensation stage, the gas product that is separated off in condensation stage 103 can be 1) fed to the pyrolysis treatment stage in order to introduce process heat, preferably after passing through a pyrolysis gas scrubbing stage 104; 2) fed to the gasification reactor 102 in order to introduce heat; 3) fed into gasification reactor 102 for further processing; 4) fed into the solid fraction prior to said fraction entering said gasification reactor 102; 5) supplying heat to the post product gas and/or to other process stages and/or 6) used as fuel in a power plant or for other gas powered equipment. If the residual gas is used for heating various other stages, it is possible to dispense with the pyrolysis gas scrubbing stage 104.

The liquid product that results after the condensation stage 103 is re-used in other processes and is preferably introduced into the gasification reactor 102. If this liquid product is to be gasified together with the solid fraction from the pyrolysis treatment stage 101, the two fractions can first be combined and then passed to the gasification reactor 102 by means of a pump or screw conveyor 107. The liquid product may also be used to heat other stages such as the gasification reactor 102, gas scrubber stage 108, etc.

Inorganic constituents in the solid fraction do not have to be removed by costly processes and can be fed directly into gasification reactor 102. The solid product which exits gasification reactor 102 is in the form of a slag which can be disposed of in an environmentally friendly manner. The product gas that results after the gasification reactor 102 is preferably scrubbed in a gas scrubber stage 108 to remove materials such as $H_2S$, HCl, dust, etc. The constituents that are removed from the product gas can be re-directed to the gasification reactor 102 for further processing. The non-product gas components such as enriched toxic gas constituents (i.e. sulphur, salt, and heavy metals) can be additionally processed.

The product gas that occurs after the gas scrubber stage 108 can, as is preferred, be fired in an existing power station 109 used to heat the pyrolysis treatment stage 101, and/or used as a source of fuel in another process.

The invention has been described with reference to a preferred embodiment and alternates thereof. It is believed that many modifications and alterations to the embodiments disclosed will readily suggest themselves to those skilled in the art upon reading and understanding the detailed description of the invention taken together with the drawings. It is intended to include all such modifications and alterations insofar as they come within the scope of the present invention.

We claim:

1. A process for preparing a synthetic gas from hydrocarbon containing material by utilizing a thermal pretreatment operation and a gasifier, said hydrocarbon containing material comprising solid or pasty residues or wastes that are difficult to handle and which residues or wastes include organic compounds, said process including the steps of:

(a) passing said hydrocarbon containing material through said thermal pre-treatment operation which includes a heated rotary tube to produce a gas fraction and a non-gas fraction, said thermal pretreatment operation subjecting said hydrocarbon containing material to sufficient heat in a controlled atmosphere to form said gas and said non-gas fractions without substantially causing combustion of said fractions, said controlled atmosphere being substantially oxygen free;

(b) feeding at least a portion of said non-gas fraction into an entrainment gasifier;

(c) gasifying said at least a portion of said non-gas fraction in said entrainment gasifier under sub-stoichiometric conditions and at temperatures of at least about 800° C. to substantially reduce oxide formation and to produce a product gas; and (d) using at least a portion of said product gas in a process selected from the group consisting of an energy supply for said entrainment gasifier, an energy supply for said thermal pretreatment operation, an energy supply for a scrubber, an energy supply for gas powered machinery and combinations thereof.

2. A process as defined in claim 1, wherein said non-gas fraction includes solids, said solids having a grain size adjusted by a technique selected from a group consisting of grinding, sieving, air, separator, sifting, screening and combinations thereof.

3. A process as defined in claim 2, wherein said grain size of said solids fed into said entrainment gasifier being about 0.001–5 mm.

4. A process as defined in claim 1, wherein at least a portion of non-hydrocarbon containing materials are removed from said non-gas fraction prior to being fed into said entrainment gasifier.

5. A process as defined in claim 2, wherein at least a portion of non-hydrocarbon containing materials are removed from said non-gas fraction prior to being fed into said entrainment gasifier.

6. A process as defined in claim 1, wherein at least a portion of said gas fraction is fed into said entrainment gasifier.

7. A process as defined in claim 5, wherein at least a portion of said gas fraction is fed into said entrainment gasifier.

8. A process as defined in claim 1, wherein at least a portion of said gas fraction is use in a process selected from the group consisting of an energy supply for said entrainment gasifier, an energy supply for said thermal pretreatment operation, an energy supply for a scrubber, an energy supply for gas powered machinery and combinations thereof.

9. A process as defined in claim 7, wherein at least a portion of said gas fraction is use in a process selected from the group consisting of a energy supply for said entrainment gasifier, an energy supply for said thermal pretreatment operation, an energy supply for a scrubber, an energy supply for gas powered machinery and combinations thereof.

10. A process as defined in claim 1, wherein additional fuels are added to said entrainment gasifier.

11. A process as defined in claim 9, wherein additional fuels are added to said entrainment gasifier.

12. A process as defined in claim 1, wherein at least a portion of said gas fraction is supplied to a condenser to produce a liquid product and gaseous product.

13. A process as defined in claim 11, wherein at least a portion of said gas fraction is supplied to a condenser to produce a liquid product and gaseous product.

14. A process as defined in claim 12, wherein at least a portion of said liquid product is fed into said entrainment gasifier.

15. A process as defined in claim 13, wherein at least a portion of said liquid product is fed into said entrainment gasifier.

16. A process as defined in claim 1, wherein said rotary tube heats said hydrocarbon containing material at a temperature of about 300° to about 650° C., at a pressure of about $0.9\times10^5$ pascals to about $1.2\times10^5$ pascals, and in a substantially oxygen free environment.

17. A process as defined in claim 15, wherein said rotary tube heats said hydrocarbon containing material at a temperature of about 300° to about 650° C., at a-pressure of about $0.9\times10^5$ pascals to about $1.2\times10^5$ pascals, and in a substantially oxygen free environment.

18. A process as defined in claim 17, wherein said entrainment gasifier operating at a pressure of about 10 bar (9.87 Atm) to about 100 bar (98.69 Atm).

19. A process as defined in claim 14, wherein at least a portion of said non-gas fraction and at least a portion of said liquid product are mixed together prior to being fed into said entrainment gasifier.

20. A process as defined in claim 18, wherein at least a portion of said non-gas fraction and at least a portion of said liquid product are mixed together prior to being fed into said entrainment gasifier.

21. A process as defined in claim 12, wherein at least a portion of said liquid product being used in process selected from the group consisting of an energy supply for said entrainment gasifier, an energy supply for said thermal pretreatment operation, an energy supply for a scrubber, an energy supply for gas powered machinery and combinations thereof.

22. A process as defined in claim 20, wherein at least a portion of said liquid product being used in process selected from the group consisting of an energy supply for said entrainment gasifier, an energy supply for said thermal pretreatment operation, an energy supply for a scrubber, an energy supply for gas powered machinery and combinations thereof.

23. A process as defined in claim 1, wherein said hydrocarbon containing material includes shredder light fraction from disposed vehicles.

24. A process as defined in claim 22, wherein said hydrocarbon containing material includes shredder light fraction from disposed vehicles.

* * * * *

UNITED STATES PATENT AND TRADEMARK OFFICE

CERTIFICATE OF CORRECTION

PATENT NO. : 6,251,148 B1 
DATED : June 26, 2001
INVENTOR(S) : Karl-Heinz Redepenning and Peter H. Wenning It is certified that error appears in the above-identified patent and that said Letters Patent is hereby corrected as shown below:

Title page,
Item [73], change the name of the first Assignee from "John Brown Deutsche Entineering GmbH" to -- John Brown Deutsche Engineering GmbH --.

Signed and Sealed this

Sixth Day of May, 2003

JAMES E. ROGAN
*Director of the United States Patent and Trademark Office*